United States Patent [19]

Tosato et al.

[11] 4,069,898

[45] Jan. 24, 1978

[54] ELEVATOR SYSTEM

[75] Inventors: Larry P. Tosato, Millburn; Robert W. Koob, Hopatcong, both of N.J.

[73] Assignee: Westinghouse Electric Corporation, Pittsburgh, Pa.

[21] Appl. No.: 710,970

[22] Filed: Aug. 2, 1976

[51] Int. Cl.[2] ..... B66B 13/24

[52] U.S. Cl. ..... 187/29 R

[58] Field of Search ..... 187/29; 200/61.08

[56] References Cited

U.S. PATENT DOCUMENTS

| | | | |
|---|---|---|---|
| 3,783,978 | 1/1974 | Hamilton | 187/29 |
| 3,791,490 | 2/1974 | Smith | 187/29 |
| 3,792,759 | 2/1974 | Kirsch | 187/29 |
| 4,011,928 | 3/1977 | Spear et al. | 187/29 |

*Primary Examiner*—Robert K. Schaefer

*Assistant Examiner*—W. E. Duncanson, Jr.

*Attorney, Agent, or Firm*—D. R. Lackey

[57] ABSTRACT

An elevator system including an interconnected elevator car and counterweight, motive means for driving the elevator car and counterweight, and apparatus for detecting mechanical damage to the elevator system, such as might be caused by an earthquake. An elongated member, such as an electrical conductor, or a conductor of electromagnetic radiation, is disposed along the vertical travel path of one of the movable components, such as the counterweight. The movable component includes a device which severs the elongated member in response to a predetermined horizontal movement of the movable component. A detector monitors the integrity of the elongated member, and it modifies the operation of the elevator system when the elongated member is severed.

8 Claims, 7 Drawing Figures

ELEVATOR SYSTEM

BACKGROUND OF THE INVENTION

1. Field of the Invention

The invention relates in general to elevator systems, and more specifically to elevator systems which include controls for detecting damage to the elevator system, such as caused by an earthquake, and then modifying the operation of the elevator system.

2. Description of the Prior Art

U.S. Pat. No. 3,792,759, which is assigned to the same assignee as the present application discloses a dual level detector arrangement for an elevator system in which at least the first level of detection is responsive to acceleration forces applied to the associated building. The two detection levels are arranged to provide an early warning of earthquake, without nuisance service outages. The second level of detection may be responsive to acceleration forces of a higher magnitude than the first level of detection, or it may be responsive to mechanical damage to the elevator system such as displacement of the counterweight from its guides.

U.S. Pat. Nos. 3,783,978; 3,791,490; 3,815,710; and 3,896,906 disclose different arrangements for detecting damage to an elevator system, which include (a) detecting the interruption of a sliding or rolling electrical contact maintained between a movable component of the elevator system and a wire or track in the hoistway, (b) detecting the mechanical contact between a conductive ring disposed on a movable component of the elevator system and a vertical wire which extends the length of the hoistway on the center line of the conductive ring, and (c) detecting mechanical contact between a plumb bob and an encircling metallic ring arrangement, both of which are carried by one of the movable components of the elevator system. Copending application Ser. No. 584,431 filed June 6, 1975, now U.S. Pat. No. 4,011,928, which is assigned to the same assignee as the present application, discloses a damage detector for an elevator system which utilizes a transmitter of radio frequency energy and a receiver therefor.

Our copending application Ser. No. 693,986, filed June 8, 1976, entitled "Elevator System" discloses a damage detector which utilizes inductive coupling between a signal generator carried by one of the movable elements and a wire vertically disposed in the hoistway.

While the prior art arrangements are effective in detecting mechanical damage to the elevator system, it would be desirable to provide a new and improved arrangement for detecting damage to an elevator system which eliminates the need for connecting a traveling cable to the counterweight, which does not depend upon detecting mechanical contact between two sensors, which does not depend upon the transmission and receiving of radio frequency energy, which does not require a battery on the counterweight, and which does not require continuous mechanical and electrical contact between a movable member and a stationary track or wire which runs the length of the hoistway.

SUMMARY OF THE INVENTION

Briefly, the present invention is a new and improved elevator system which detects mechanical damage to one of its movable components, such as displacement of the counterweight from its guides, without requiring a traveling cable or a battery on the counterweight, the detection of mechanical contact between two sensors, or a continuous mechanical and electrical connection between the counterweight and a special conductive track in the hoistway.

A conductor of electricity, or a conductor of electromagnetic radiation such as visible or invisible light, is strung vertically in the hoistway, adjacent to the movable component to be monitored, or through a vertically oriented opening in the movable component. The movable component includes means for severing the conductor, which means is mechanically operated by predetermined movement of the movable component relative to one of its guide rails. A detector mounted remotely from the movable component utilizes the integrity of the elongated member to place a control device in a first condition. Severance of the elongated member causes the control device to change to a second condition which initiates a modification in the operation of the elevator system.

BRIEF DESCRIPTION OF THE DRAWINGS

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

Figure 1:
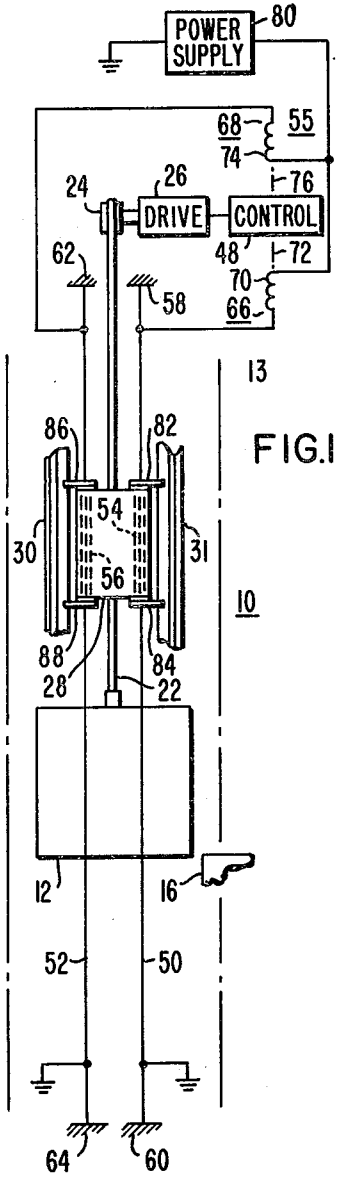
FIG. 1 is a diagrammatic, elevational view of an elevator system constructed according to the teachings of the invention.

Referring now to the drawings, and FIG. 1 in particular, there is shown an elevator system 10 constructed according to the teachings of the invention. While the invention applies to the monitoring of either of the movable components of a traction elevator system, for purposes of example it will be applied to the counterweight, as this is the component which is usually monitored. Elevator system 10 includes an elevator car 12 mounted for vertical movement in the hoistway of a building or structure having a plurality of floors or landings, such as the landing indicated generally at 16. The elevator car 12, which is guided in a vertical path by T-shaped guide rails (not shown), is supported by a plurality of wire ropes 22, with the ropes 22 being reeved over a traction sheave 24 mounted on the shaft of suitable motive means, such as a drive motor 26. A counterweight 28, guided in a vertical path by T-shaped guide rails 30 and 31, is connected to the other end of the ropes 22.

The motor 26 drives the sheave 24 in response to elevator drive control, shown generally at 48. According to the teachings of the invention, the control 48, in response to damage to the elevator system, modifies the operation of the motive means 26. Damage to the elevator system is detected by new and improved damage detector apparatus which includes at least one or a first elongated member 50, and in a preferred embodiment, an additional or second elongated member 52, which elongated members are disposed along the travel path of the counterweight 28. The elongated members may be disposed immediately adjacent to the counterweight 28, or, as illustrated in FIG. 1, the counterweight 28 may be constructed to define first and second vertical openings 54 and 56, respectively, which extend completely through the counterweight, with the first and second elongated members 50 and 52 being disposed through the openings 54 and 56, respectively.

The elongated members 50 and 52 are conductors. In certain embodiments of the invention they are conductors of electricity, and in other embodiments they are conductors of electromagnetic radiation, such as visible or invisible light. In the embodiment of the invention shown in FIG. 1, they are conductors of electricity, i.e., metallic wires, and they are tensioned and fastened below and above the travel limits of the counterweight 28. Wire 50 is fastened by suitable anchors indicated generally at 58 and 60, and wire 52 is fastened by anchors indicated at 62 and 64.

Wires 50 and 52 are an integral part of a damage detector system 55 which includes control devices 66 and 68 which monitor the integrity of the wires 50 and 52, respectively. Control devices 66 and 68 may be any suitable means operable between first and second conditions, with the means being in one condition when the associated wire is whole, and in the other condition when the associated wire has been broken or severed. For purposes of example, devices 66 and 68 are each electromagnetic relays, with relay 66 having an electromagnetic coil 70, and a movable mechanical member indicated by broken line 72 which operates one or more contacts in control 48. Relay 68 includes an electromagnetic coil 74, and a movable member indicated by broken line 76 which operates one or more contacts in control 48.

In the embodiment of the invention shown in FIG. 1, the wires 50 and 52 are each electrically grounded. If the detector system 55 which monitors the integrity of the wires is above the travel path of the counterweight 28, as illustrated in FIG. 1, the wires are electrically grounded at a point below the travel path of the counterweight. If the detector system were to be mounted below the travel path of the counterweight, the wires would be grounded at a point located above the travel path.

The electromagnetic coils 70 and 74 each have one end connected to wires 50 and 52, respectively, and their other ends are connected to one side of a power supply 80, which has its other side grounded. Thus, when wires 50 and 52 are whole, the electromagnetic coils 70 and 74 are each energized and their associated contacts in control 48 are in a condition which permits normal operation of the elevator system 10.

The damage sensor portion of the elevator system 10 is a completely mechanical system mounted on the counterweight, and as such it does not require a battery or a traveling cable. Each wire requires at least one device for mechanically sensing the relative horizontal positions of the counterweight and its guide rails, and at least one device for breaking, cutting or severing the associated wire should the mechanical sensor indicate a predetermined relative horizontal movement between the counterweight and its guide rails. Thus, each wire 50 and 52 may include first and second sensor/cutter assemblies, indicated generally at 82 and 84 for wire 50, and at 86 and 88 for wire 52. Sensor/cutter assemblies 82 and 86 are mounted on the top of the counterweight, and sensor/cutter assemblies 84 and 88 are mounted on the bottom of the counterweight. Other possible combinations within the scope of the invention are: (a) a single wire with a single sensor/cutter assembly mounted on the top or on the bottom of the counterweight, (b) a single wire with two sensor/cutter assemblies mounted on the top and bottom of the counterweight, (c) a single wire with a single sensor/cutter assembly mounted on the top or on the bottom of the counterweight, and one or more mechanical position sensors mounted at other locations on the counterweight which are mechanically linked to trigger the cutter portion of the single sensor/cutter assembly, and (d) two wires, each with any of the above listed combinations. A suitable sensor/cutter assembly which may be used for those shown generally in FIG. 1, such as the sensor/cutter assembly 82 located on the top of the counterweight 28, is shown in detail in FIGS. 5, 6 and 7, and will be hereinafter described.

In the event a wire is cut, its associated control device is operated from one condition to another condition, and its contact or contacts located in control 48 change their position to modify the operation of the elevator system 10.

Figure 4:
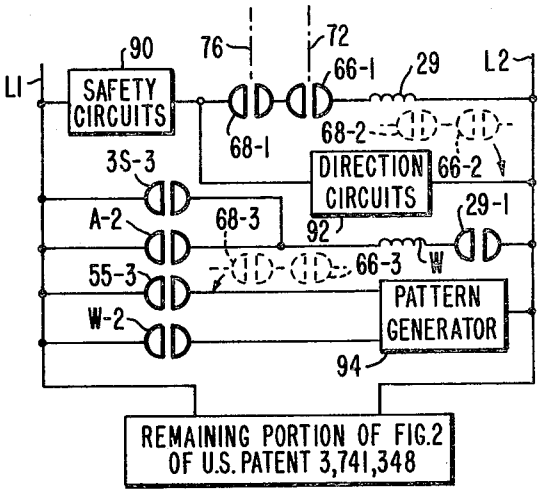
FIG. 4 is a schematic diagram of elevator control constructed according to the teachings of the invention.

FIG. 4, which will be hereinafter explained in detail, is a schematic diagram of control 48, illustrating how contacts from control devices 66 and 68 may be arranged to modify the operation of the elevator system 10. It will be noted that the system is failsafe, since any malfunction in the detector system will cause control devices 66 and 68 to drop out or to become deenergized and thus modify the operation of the elevator system and automatically call attention to the fact that the damage detector system requires maintenance.

Figure 2:
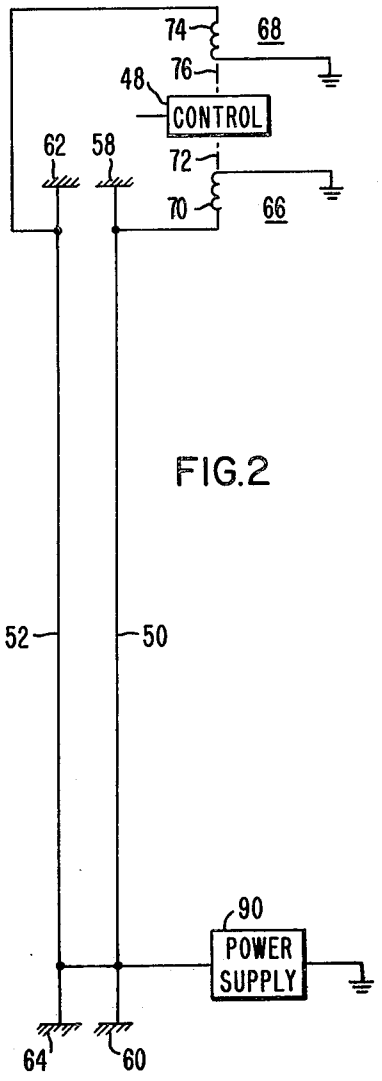
FIGS. 2 and 3 are fragmentary, elevational views, which illustrate modifications of the elevator system shown in FIG. 1.

FIG. 2 illustrates another embodiment of the invention utilizing electrically conductive wires 50 and 52 and sensor/cutter assemblies. Since the elevator system associated with FIG. 2 would be the same as illustrated in FIG. 1, it is not shown again in order to simplify the drawing. In the embodiment of FIG. 2, instead of grounding the wires 50 and 52, the wires are insulated from ground and they are connected to a low voltage power supply 90, such as a 12 volt power supply. If the detector system is located above the travel path of the counterweight, the power supply 90 is connected to the wires 50 and 52 below the travel path, and vice versa. The electromagnetic coils 70 and 74 are connected to wires 50 and 52, respectively, and the other ends of the electromagnetic coils are grounded. Breakage or severance of either wire, or failure of the power supply 90, will deenergize the associated control device, initiating the modification in the operation of the elevator system.

Figure 3:
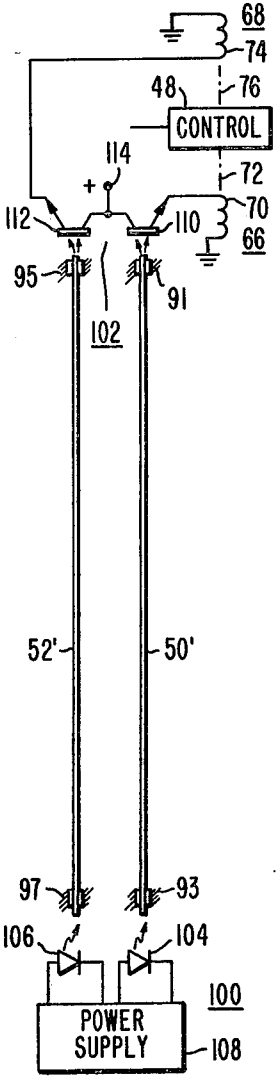

FIG. 3 illustrates still another embodiment of the invention. In this embodiment, the elongated members 50 and 52 are conductors of electromagnetic radiation, such as light having a wavelength in the visible range, light having a wavelength in the invisible range, such as infra red radiation, or any other suitable wavelength, and the conductors in this embodiment are referenced 50' and 52' in order to indicate that they differ from the electrically conductive wires 50 and 52 of the FIGS. 1 and 2 embodiments. Each of the elonated members 50' and 52' may include one or more optical fibers, sometimes referred to as "light pipes." Optical fibers are conventially formed of glass, but any other suitable material may be used.

The elongated members 50' and 52' are supported close to their ends by suitable supports, shown generally at 91 and 93 for elongated member 50' and at 95 and 97 for elongated member 52'.

A source or transmitter of electromagnetic radiation, indicated generally at 100, is disposed at one end of the elongated members 50' and 52', and a receiver 102 of the electromagnetic radiation is disposed at the other end of the elongated members. The source 100 may include light emitting diodes 104 and 106, for elongated members 50' and 52', respectively, which are connected to a suitable power supply 108. A laser, such as a laser diode, may be used, if desired.

The receiver or light sensor 102 may include photo diodes, photo resistors, light activated SCR's (LASCR), photo sensitive FET's, photo-Darlington's, or photo transistors, such as photo transistors 110 and 112 shown in FIG. 3. The photo transistors 110 and 112 have their collectors connected to a source 114 of unidirectional potential, and their emitters are connected to the electromagnetic coils 70 and 74, respectively. The remaining ends of the electromagnetic coils 70 and 74 are grounded.

If source 100 is operative, and the light pipes 50' and 52' are whole or continuous, and the receiver 102 is operative, relays 66 and 68 will be energized, and the control 48 will operate the elevator system 10 in a normal manner. Should the counterweight 28 move relative to its guide rails, triggering a sensor/cutter assembly hereinbefore described relative to FIG. 1, the associated light pipe will be cut or broken, the associated electromagnetic relay will drop out, and the operation of the elevator system 10 will be modified. Failure of the source 100 or receiver 102 will also cause the elevator system operation to be modified, automatically calling attention to the fact that the damage detector system requires maintenance.

FIG. 4 is a schematic diagram of a portion of an elevator control system, which may be the control system shown generally at 48 in FIG. 1. The control of any elevator system may be modified to operate according to the teachings of the invention. For purposes of example, the elevator control disclosed and described in U.S. Pat. No. 3,741,348, which is assigned to the same assignee as the present application, will be used to illustrate the invention. Only a portion of the control illustrated in U.S. Pat. No. 3,741,348 which is necessary to understand the present invention is shown in the present application, as reference may be had to this patent for additional information, if required.

The relay contacts in FIG. 4 of the present application are identified by hyphenated reference characters. The portion of the reference character before the hyphen identifies the relay with which the contacts are associated, and the number after the hyphen identifies the contacts on the associated relay. All of the relay contacts are shown in their normal position when the relay is deenergized.

As an aid to understanding FIG. 4, the relays and switches are identified as follows:

A — Brake Monitor Relay
W — Pattern Selector Relay
3S — Running Relay
29 — Safety Circuit Relay
55 — Overspeed Relay
66-1 — N.O. Contact of Control Means 66
68-1 — N.O. Contact of Control Means 68

Control 48 includes a safety circuit relay 29 connected between electrical buses L1 and L2 via conventional elevator safety circuits, shown generally at 90, and through the serially connected make or normally open contacts 66-1 and 68-1 which are responsive to the control devices 66 and 68, hereinbefore described. When the damage detector system is operating properly, control devices 66 and 68 will be energized and contacts 66-1 and 68-1 will be closed. The safety relay 29 may thus be energized through the normal safety circuits 90 of the elevator system 10. Should either control device 66 or 68 drop out, its associated contacts 66-1 or 68-1 will open to drop the safety relay 29. Relay 29 has contacts 29-1 which enable the operation of the pattern selector relay W.

The direction circuits of control 48, shown generally at 92 are connected to be energized through the safety circuits 90. The pattern selector relay W is energized through contacts 29-1 when the running relay 3S (not shown) is energized via contacts 3S-3 of the running relay, and it remains energized until the brake is applied, indicated by contacts A-1 of the brake monitor relay A (not shown) opening. Relay W has make contacts W2 connected in the circuit of a pattern generator 94.

The pattern generator 94, which is shown in detail in U.S. Pat. No. 3,741,348, energizes solenoids which lift pawls clear of the floor stops located in the pattern generator. The stop relay (not shown) breaks this circuit when energized to stop the car at a landing. The overspeed relay 55 (not shown) is energized through an overspeed switch, which opens at a predetermined percentage of overspeed, such as 10%. The overspeed relay 55 has contacts 55-3 which open when relay 55 drops out, to drop the pawls and thus stop the car at the closest landing at which the car can make a normal stop.

Contacts W-2 of the pattern selector relay are also connected to the pattern generator 50, in a circuit which normally opens when the floor stop of the pattern generator is captured by a dropped pawl. If the safety relay 29 is deenergized, relay W drops to open contacts W-2, which simulates the capturing of a floor stop by a pawl, stopping the car without regard to its location relative to a landing.

In the operation of the damage detector system, when an elongated member such as 50, 52, 50' or 52', is cut or broken, such as due to an abnormal horizontal movement of the counterweight, relay 66 or relay 68 drops, and its associated contacts 66-1 or 68-1 open. The safety relay 29 drops, opening its contacts 29-1 and the opening of contacts 29-1 deenergizes the pattern selector relay W. Contacts W-2 of the pattern selector relay thus open, to immediately initiate slowdown of a moving elevator car. The elevator car thus stops without regard to its stopped location relative to a floor level. A car which is already stopped at a floor when the safety relay 29 is deenergized, cannot be started.

Instead of stopping a moving car without regard to its stopped location relative to a landing, a moving car may be stopped at the closest landing in its travel direction at which it can make a normal stop, by eliminating contacts 66-1 and 68-1, by adding serially connected N.O. contacts 66-2 and 68-2, shown in phantom in FIG. 4, between the direction circuits 92 and bus L2, which prevents the starting of a stationary car when either control device 66 or 68 is deenergized, and by adding serially connected N.O. contacts 66-3 and 68-3, also shown in phantom in FIG. 4, in series with contacts 55-3. Contacts 66-3 or 68-3, when open, will stop a moving car at the closest floor in its travel direction at which it can make a normal stop.

As described in the hereinbefore mentioned U.S. Pat. No. 3,792,759, the speed of the elevator car may be automatically reduced, if desired, by appropriately located contacts from the control devices 66 and 68. Also as disclosed in this patent, a manually operated override switch may be concealed in the elevator car, the location of which is known only to authorized personnel. This override switch, when actuated, operated an override relay which permits operation of the elevator car at reduced speed.

Figure 6:
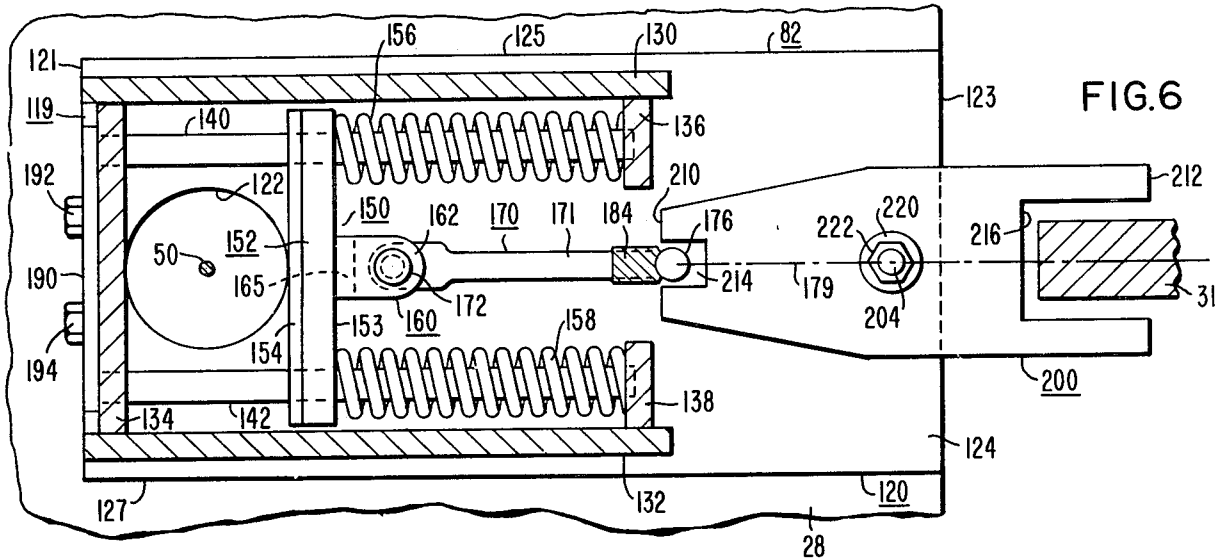
FIGS. 5, 6 and 7 are elevational, plan, and end views, respectively, of a sensor/cutter assembly which may be utilized in the embodiments of the invention shown in FIGS. 1, 2 and 3.
Figure 5:
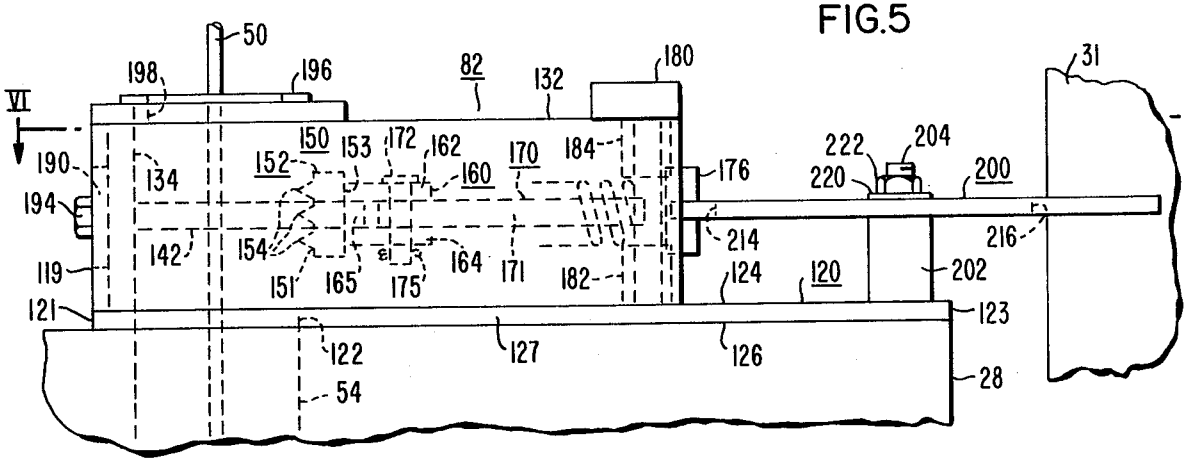
Figure 7:
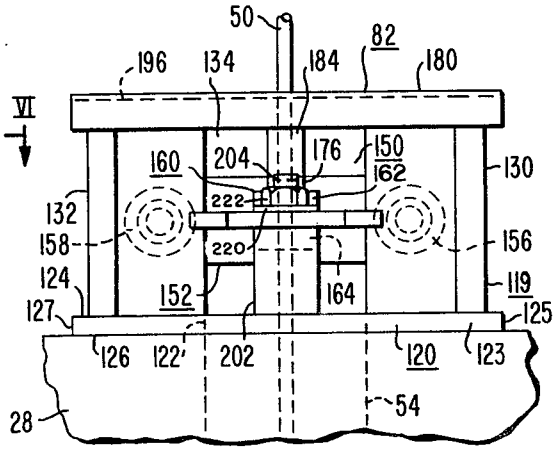

FIGS. 5, 6 and 7 are elevational, plan, and end views, respectively, of a sensor/cutter assembly 82 which may be used for assembly 82 shown in FIG. 1, or for any of the other sensor/cutter assemblies 84, 86 and 88, shown in FIG. 1. FIG. 6 is a plan view, in section, of the view shown in FIG. 5, taken between and in the direction of arrows VI—VI.

More specifically, sensor/cutter assembly 82 includes a stationary frame 119 having a rectangularly shaped mounting base 120. Base member 120 includes first and second ends 121 and 123, respectively, and first and second side edges 125 and 127, respectively, and first and second flat, major opposed surfaces 124 and 126, respectively. An opening 122 is provided near the first end 121 which extends between the major surfaces 124 and 126.

Frame 119 further includes a superstructure mounted on and secured to surface 124 of the base member 120, with the vertically oriented members of th superstructure having a substantially C-shaped cross sectional configuration as viewed in the plan view of FIG. 6. The super-structure includes first and second spaced, parallel side members 130 and 132, which start at end 121 of the base member 120 and extend along and adjacent to the side edges 125 and 127 of the base member 120. The side members terminate before reaching end 123. A back member 134 extends between the side members 130 and 132 such that the plane of its inner surface is tangent to an edge of opening 122 as viewed in FIG. 6. First and second spring seat members 136 and 138 are mounted on the base 120 adjacent to the ends of the side members 130 and 132 which face the end 123 of the base member 120. The spring seat members are aligned with one another, but are dimensioned to provide a space between their facing edges.

Back member 134 has first and second spaced openings therein for receiving first and second guide rod members 140 and 142, respectively, which guide rod members extend into blind openings in the spring seat members 136 and 138, respectively.

The guide rod members 140 and 142 support and guide a movable cutter assembly 150 which includes a cutter head 152 slidably mounted on the guide rod. The cutter head 152 has first and second major sides 151 and 153, respectively, with one or more sharpened teeth 154 disposed on the first side 151 which faces end 121 of the base member 120. First and second coil spring members 156 and 158, respectively, are mounted on the guide rod members 140 and 142, respectively, between the side 153 of the cutter head 152 which faces end 123 of the base member 120, and the spring seat members 136 and 138, respectively. A stationary pivot mount 160 is attached to side 153 of the cutter head 152, with the pivot mount 160 having a substantially U-shaped cross sectional configuration when viewed in FIG. 5, with the U shape being formed by first and second vertically spaced portions 162 and 164, respectively, which extend outwardly from a connecting or bight portion 165.

A release arm assembly 170 is pivotally mounted on the pivot mount 160. The release arm assembly includes a pivot arm 171 having an opening at one end and a pin member 176 fastened at the other end. The pivot arm 171 is pivotally mounted to the pivot mount 160 by a pivot pin 172 which extends between aligned openings disposed through the spaced portions 162 and 164, and through a suitable opening formed in the pivot arm. A cotter pin 175 shown in FIG. 5 is disposed through an opening in the lower end of pin 172, to secure the pivotable assembly once it is assembled.

The pin 176 fastened to the outwardly extending end of the pivot arm 171 has its longitudinal axis vertically oriented, and its longitudinal dimension is selected such that it extends both above and below the pivot arm 171.

A cross plate member 180 is fastened across the top portion of the upwardly extending side members 130 and 132, and it is disposed adjacent their ends which face end 123 of the base member 120. Upstanding and depending post members 182 and 184, respectively, are vertically spaced from one another, with the upstanding post member 182 being fastened to the brake member 120, and with the depending post member being fastened to the cross plate member 180. The post members 182 and 184 are vertically spaced such that the pivot arm 171 will pass therethrough without interference. The post members 182 and 184 are disposed on the same imaginary line 179 shown in FIG. 6, which intersects the center of the opening 122 and the pivot axis of the pivot mount 160. The post members 182 and 184 each include a slight depression in their surfaces which face end 123 of the base member 120, which depressions receive pin member 176 of the release arm assembly 170 when the release arm assembly 170 is armed.

In the assembly of the components described thus far, the guide rods 140 and 142 would be inserted through the openings in the back member 134, through the openings in the cutter head 152, through the spring members 156 and 158, into the blind openings in the spring seat members 136 and 138. A keeper plate member 190 is then secured across the outer surface of back member 134, such as by screws 192 and 194, with the keeper plate being dimensioned to cover the openings in the back member 134 and thus maintain the guide rod members 140 and 142 in the proper assembled positions. A wire guide plate 196 is disposed across the upper edges of the side members 130 and 132 and back member 134, with the guide plate 196 having an opening 198 therein which is aligned with the opening 122 formed in the base member 120.

An actuator arm 200 is pivotally mounted to surface 124 of base member 120 adjacent end 123 of the base member, such as via an upstanding support member 202 which has a threaded upstanding post portion 204 of smaller diameter at its upper end. The longitudinal axis of the upstanding support member 202 is located on the imaginary line 179. The actuator arm 200 includes an opening near its midpoint for receiving the threaded post 204.

The sensor/cutter assembly 82 is mounted on the counterweight 28 with the opening 198 in the wire guide 196 and the opening 122 in the base member 120 aligned with the opening 54 disposed through the counterweight 28. The end 123 of the base member 120 is substantially aligned with a side edge of the counterweight 28. The pivot post 202 is mounted adjacent end 123 of the base member, such that the actuator arm 200 extends outwardly past the end 123 of the base member 120. Actuator arm 200 has first and second end portions 210 and 212, respectively, with end 210 having a U-shaped opening 214, best shown in FIG. 6, for receiving the pin 176, and a larger U-shaped opening 216 at end 212, also best shown in FIG. 6, for receiving the guide rail 31. In the assembly of the actuator arm 200, the cutter mechanism 150 would first be armed by pulling the pin 176 against the bias of the springs 156 and 158 until the pin 176 clears the posts 182 and 184, and then pin 176 is pivoted into alignment with the imaginary line 179 and released to rest in the slight depressions formed in the posts 182 and 184. The actuator arm 200 would then be oriented such that opening 216 straddles the guide rail 31, and the arm 200 may then be lowered onto post 204 such that opening 214 will straddle pin 176. A washer 220 and nut 222 would then be assembled on post 204 such that the actuator arm 200 is secured but free to pivot about the post 204. The elongated member 50 may then be strung in the hoistway, through the aligned openings in the sensor/cutter assembly 82 and counterweight 28. The procedure of arming the cutter assembly prior to assembly of the arm 200 will not be necessary if the normal clearance between the outwardly extending fingers of the opening 216 and the guide rail 31 permit the arm 200 to be pivoted sufficiently to receive pin 176 as it is being moved against the bias of the spiral springs to arm the cutter assembly.

Opening 216 is sized such that the sensor or actuator arm 200 will not contact the guide rail due to normal tolerances as the counterweight 28 moves up and down the hoistway. If an abnormal horizontal movement occurs between the counterweight 28 and guide rail 31, the actuating arm 200 will be pivoted about post 204, striking and moving pin 176 from its supporting posts 136 and 138, triggering the cutter. The cutter head 152 is propelled by the force stored in the springs 156 and 158, cutting the elongated member 50 when the teeth 154 force the elongated member 50 against the back plate member 134.

In summary, there has been disclosed a new and improved elevator system which includes means for detecting damage to a movable component of the system, such as abnormal horizontal movement of the counterweight, and means responsive to such detection for modifying the operation of the drive control of the elevator system. The means for detecting damage includes mechanically operated sensor means on the counterweight which does not require a battery on the counterweight, or a traveling cable to the counterweight, it does not require a continuous track which runs the length of the hoistway which must be in continuous mechanical and electrical contact with a movable element of the elevator system in order for the elevator system to operate normally, it does not have to operate within the constraints of F.C.C. requirements, since it does not generate radio frequencies, and it does not depend upon mechanical contact between two spaced sensors. Thus, the installation of the elevator system is simplified, as well as the maintenance thereof, and it is a very reliable system not subject to nuisance outages. It is also relatively easy to add the damage detector arrangement of the invention to an existing elevator installation.

We claim as our invention:

1. An elevator system, comprising:
a movable component,
guide means for guiding said movable component in a vertical travel path,
motive means for driving said movable component,
at least one elongated member disposed along the travel path of said movable component,
severing means responsive to a predetermined horizontal movement of said movable component for severing said at least one elongated member,
and detector means responsive to the integrity of said elongated member,
said detector means modifying the operation of the elevator system when said at least one elongated member is severed.

2. The elevator system of claim 1 wherein the movable component is a counterweight, and wherein said counterweight defines a vertical opening through which the elongated member is disposed.

3. The elevator system of claim 1 wherein the elongated member is electrically conductive, and the detector means includes control means connected to provide a predetermined electrical circuit which includes the elongated member, and wherein the severing of the elongated member by the severing means modifies said predetermined electrical circuit causing said control means to initiate the modification in the operation of the elevator system.

4. The elevator system of claim 3 wherein the elongated member is connected to electrical ground below the vertical travel path of the movable component.

5. The elevator system of claim 3 wherein the detector means includes an electrical power supply connected to the elongated member below the vertical travel path of the movable component.

6. The elevator system of claim 1 including a second elongated member spaced from the at least one elongated member, the severing means is responsive to predetermined horizontal movement of the movable component for severing one or both of the elongated members, and the detector means is responsive to the integrity of both elongated members, initiating the modification in the operation of the elevator system when either is severed.

7. The elevator system of claim 1 wherein the elongated member is a conductor of electromagnetic radiation, and wherein the detector means includes a source and a receiver of electromagnetic radiation disposed at opposite ends of the elongated member, respectively, wherein the detector further includes means responsive to the receiver failing to receive electromagnetic radiation from the source via the elongated member, for initiating the modification in the operation of the elevator system.

8. The elevator system of claim 1 wherein the guide means includes a guide rail and the severing means includes a U-shaped actuator member disposed to straddle the guide rail and cutting means disposed to sever the elongated member responsive to predetermined movement of the U-shaped actuator by said guide rail.

* * * * *